US006618876B2

(12) United States Patent
Murphy et al.

(10) Patent No.: US 6,618,876 B2
(45) Date of Patent: Sep. 16, 2003

(54) WALL-HUNG DECORATIVE HEADBOARD FOR A BED

(76) Inventors: Stephen Murphy, 128 Blackville Rd., Washington Depot, CT (US) 06794; William R. Grose, 128 Blackville Rd., Washington Depot, CT (US) 06794

( * ) Notice: Subject to any disclaimer, the term of this patent is extended or adjusted under 35 U.S.C. 154(b) by 0 days.

(21) Appl. No.: 10/051,233

(22) Filed: Jan. 18, 2002

(65) Prior Publication Data

US 2003/0135928 A1 Jul. 24, 2003

(51) Int. Cl.[7] ..... A47C 31/00
(52) U.S. Cl. ..... 5/53.1; 5/658; 160/38
(58) Field of Search ..... 5/53.1, 658, 425; 160/38, 39

(56) References Cited

U.S. PATENT DOCUMENTS 2,569,290 A * 9/1951 Collester
5,615,722 A * 4/1997 Garrett et al. ..... 160/38
5,785,188 A * 7/1998 Ogden ..... 160/38
6,182,307 B1 * 2/2001 Rutrick ..... 5/53.1
6,371,190 B1 * 4/2002 Owens ..... 160/135

* cited by examiner

*Primary Examiner*—Alexander Grosz
(74) *Attorney, Agent, or Firm*—Hosmer & Reiter; Howard S. Reiter

(57) ABSTRACT

A bed headboard assembly that is entirely independent of support associated with any other part of a bed structure such as the mattress, spring or bed frame, embodies a generally soft, panel-like member having length and width dimensions that are substantially greater than its thickness. A fabric container encloses the panel and has an access opening for inserting and removing the panel. The access opening can be dosed with a zipper or hook-and-loop closure device. A rigid support member is coupled to the panel member parallel to one edge, so that the panel can be suspended from the support when said support is hung on a wall next to a bed. Decorative patterns on the outer surface of the fabric container and pocket recesses in either the fabric or the panel or both, enhance the functions of the headboard for visual appeal and for the convenience of a user of the bed. In a preferred embodiment, the rigid support is coupled to the panel by removably capturing at least part of the support within the confines of the fabric container.

9 Claims, 4 Drawing Sheets

WALL-HUNG DECORATIVE HEADBOARD FOR A BED

FIELD OF THE INVENTION

This invention relates generally to bed accessories and more specifically relates to decorative headboards that accompany, but are not attached to, the supporting structure of the bed.

It is well-known that contemporary bed structures frequently comprise a mattress resting on a box spring which is, in turn supported above the floor by a frame like arrangement equipped with legs which may have wheels or gliders attached at their free ends, in contact with the floor. This basic structure provides what are commonly accepted as the "basics" of a bed structure in most of current Western cultures, namely a mattress and a supporting spring for the mattress, both supported at a reasonable height above the floor to assure the comfort and desired elevation of the occupant. Often, a decorative headboard and or foot board is attached to either the spring or its supporting frame, or both, to enhance the visual appearance of the bed and the space in which the bed is housed.

However, despite the generally accepted attractiveness of headboards and footboards, they are, in many instances, omitted entirely due to the exigencies of modern living and the nomadic nature of current lifestyles. That is, they substantially increase the initial cost of the bed along with imposing additional moving and storage expense when it becomes necessary to move from one living location to another. Furnishing homes for the young raises the additional consideration of maturing and evolving tastes which result in the attractive physical appearance of this year'as head and/or footboard rapidly being regarded as out-of-style and unappealing in ensuing years.

DESCRIPTION OF THE INVENTION

The decorative headboard for a bed in accordance with the present invention avoids the excessive storage space requirements of existing headboard structures and further overcomes many of the problems associated with frequent obsolescence of style, color and overall appearance. A headboard in accordance with this invention is formed of soft, flexible material that may be compressed easily into a minimum of space for moving and storage. It is housed in a removable and replaceable casing so that its color and decorative appearance may be changed readily, essentially at will.

Because the headboard of this invention is intended to be hung on a wall, or any available and suitable vertical structure, in proximity to a bed, without being attached to the mattress, spring or other supporting structure for these elements, this headboard occupies none of the valuable floor space that is often severely limited in small, modem residential units. An elongate, substantially rigid, rod-like supporting element which allows the headboard to be suspended on a wall, represents the only substantially non-compressible element of the invention. This support element, however, although it may in some instances extend to a length on the order of seven feet, occupies essentially no significant volume because its width or diameter may be as little as one inch or so. And, because the elements of this headboard, with the exception of the supporting member, all serve essentially non-structural functions, they can be chosen from among a wide variety of light-weight and easily cleaned or sanitized materials.

SUMMARY OF THE INVENTION

In the disclosed embodiment of the invention, the wall hung headboard comprises a generally soft, panel-like member having length and width dimensions that are substantially greater than the thickness of the panel; a fabric container enclosing the panel and having an access opening for inserting and removing the panel from within the container so that the container can be cleaned changed, etc.; and a rigid support member that is coupled to the panel member parallel to one edge of the panel, so that when the support is fastened to a wall next to the bed, the panel will be suspended from the support, next to the bed, in a desired and decoratively attractive relationship. Decorative patterns can be made visible on the outer surface of the fabric container and pocket recesses can be formed in either the fabric or the panel or both to enhance the functions of the headboard for visual appeal and for the convenience of a user of the bed. In a preferred embodiment, the rigid support is coupled to the panel by removably capturing at least part of the support within the confines of the fabric container.

These and other features, objects and advantages of this invention will be made more apparent to those having skill in this art, by reference to the following specification considered in conjunction with the accompanying drawings, in which:

DETAILED DESCRIPTION OF THE PREFERRED EMBODIMENT

In the following description, certain specific details of the disclosed embodiment such as fastenings and assembly methods are set forth for purposes of explanation rather than limitation, so as to provide a dear and thorough understanding of the present invention. However, it should be understood readily by those skilled in this art, that the present invention may be practiced in other embodiments which do not conform exactly to the details set forth herein, without departing significantly from the spirit and scope of this disclosure. Further, in this context, and for the purposes of brevity and clarity, detailed descriptions of well-known apparatus, structural elements and techniques have been omitted so as to avoid unnecessary detail and prolixity.

Figure 1:
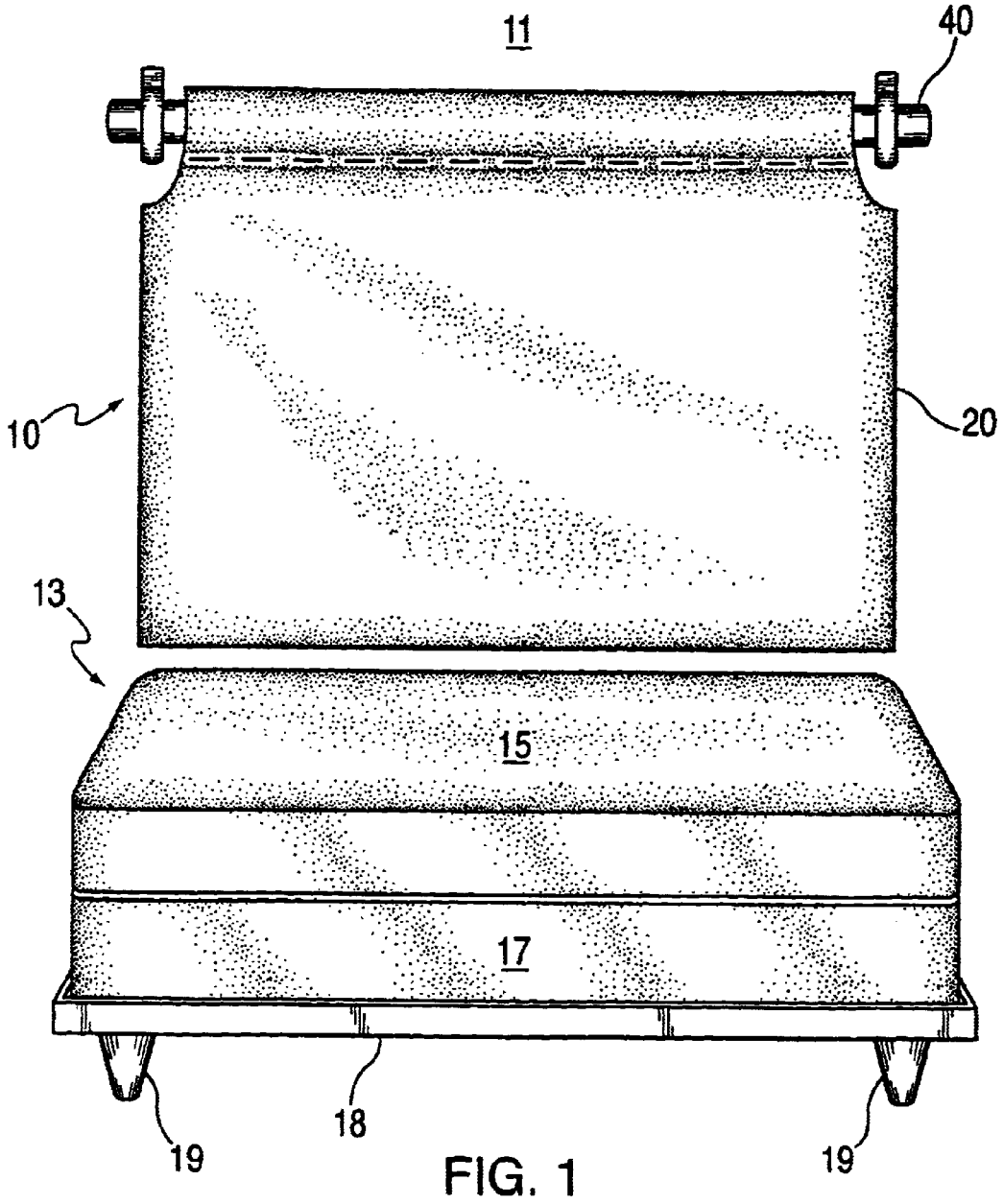
FIG. 1 is a simplified pictorial representation of a preferred embodiment of decorative bed headboard in accordance with this invention.
Figure 2:
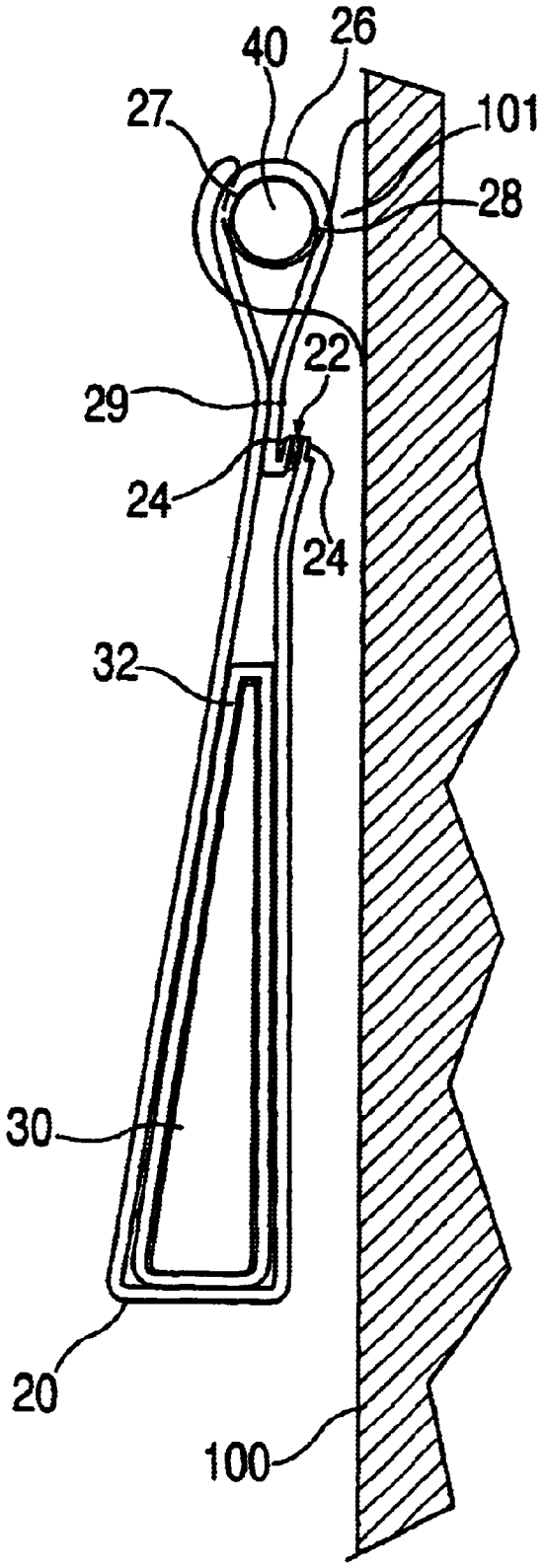
FIG. 2 is a cross-sectional view of the embodiment of the decorative bed headboard shown in FIG. 1.

Referring now more specifically to the drawings, the decorative headboard 10 illustrated in FIGS. 1 and 2 is shown hung on the surface of a wall 11, having a conventional bed 13 positioned so as to extend away from the wall beneath headboard 10. Bed 13 comprises, for purposes of illustration only, a mattress 15, supported on a spring assembly 17 which is in turn supported by a bed frame 18 having legs 19. The elements of bed 13 form no part of the present invention. Headboard 10 may be seen to comprise a fabric container 20 substantially enclosing a generally soft, panel-like member 30. It will be understood readily by those having skill in this art that panel member 30 may be formed of shaped foam rubber or of any one of numerous alternate materials that offer similar and suitable parameters of texture, softness, conformability, shapability and overall shape retention characteristics.

For example, the loose filling materials often used to form bed pillows can be used similarly to form panel member 30 in accordance with this invention provided only that such loose fillings must be contained, preferably independently of fabric container 20, so as to maintain the panel-like configuration. If such loose filling materials are used to form panel-like member 30, a separate, second fabric container 32 may be used to contain the filling within container 20. Even if member 30 is formed of a unitary body of coherent material, it will be understood that separate container 32 may be used, if desired, to provide protection and a renewable surface for such a body. In such case, separate container 32 would be provided with an access opening for insertion and removal of the inner panel member 30; the functioning and closure, if desired, of such an access opening would be similar, and could be essentially identical in nature, to the access opening 22 in container 20 which is explained later in this disclosure.

Member 30 is described as having a panel-like structure in that, in general, it is rectangular in shape and has length and width dimensions, generally coextensive with the length and width of container 30, that are significantly greater than its thickness dimension. The thickness is shown in FIG. 2, emphasized only slightly relative to the length and width dimensions suggested in FIG. 1. This configuration, together with the materials referred to above, has the added advantage of being easily deformed and/or compressed into a desired space and shape for shipping and storage purposes. In addition, it serves a comfort and protective purpose in serving to protect the head of an occupant of the bed from contact with the adjacent wall. The panel-like configuration of member 30 permits it to be displayed, in the manner of a painting or other form of wall art, when it is suspended on a wall in accordance with this invention. Although the length and width dimensions of panel 30 have been described as being substantially greater than its thickness dimension, it should be understood that there is no need for the thickness dimension to be uniform in nature; various thickness configurations, for example an alternating thickness pattern such as is defined by a "waffle" configuration may be adopted if desired, or, as a further example, the preferable wedge-shaped configuration shown in FIG. 2, may be used.

As seen most clearly in FIG. 2, fabric container 20 is provided with an access opening 22 that is retained in a closed position by any suitable closure means 24 including simple lace-like ties, individual buttons or snap fasteners, or a strip fastener such as a zipper or a hook-and-loop device of the kind that is commercially available under the Trademark VELCRO. Although access opening 22 is shown formed across the top of container 20, it should be understood that the location of opening 22 is not material, and the opening can be formed at any convenient point on container 20. Access opening 22 allows panel member 30 to be removed from within fabric container 20 and to be reinserted, easily, for purposes of cleaning either or both panel 30 and container 20. It is significant that use of the access opening 22 also allows container 20 to be separated from panel member 30 and replaced by different containers 20 having, for example, different colors and patterns on their exposed surfaces, permitting the user to change decorative themes, substantially at will.

To use decorative headboard 10 in accordance with the invention, container 20 must be suspended on a support structure such as a structural wall, from at least two separate points that are positioned a fixed distance apart. This is accomplished, as shown in the accompanying drawings, by an elongate, substantially rigid support member 40 that is coupled to a panel member 30 parallel to one edge thereof, by passing support 40 through a coupling portion 26 of fabric container 20, so that the panel 30 is suspended from the support 40 when the support is hung on a wall 100 next to a bed. Support 40 has the general configuration of a rod, such as a curtain rod, for example, having sufficient strength and rigidity to support the combined weight of itself, panel member 30 together with any material associated with the panel (e.g. a second container 32), fabric container 20, and any usable material such as books, tissue containers, telephones. etc, that a user of the bed may associate with the headboard 10 as disclosed herein, in the normal course of occupying a bed. As shown in FIG. 2, support rod 40 is coupled to a panel member 30 via container 20 by inserting rod 40 into coupling portion 26 of container 20 which is, in turn, coupled to panel 30 when the panel is positioned within container 20.

Coupling portion 26 of container 20 preferably is incorporated into the structure of container 20. For example, as shown in FIG. 2, coupling portion 26 is defined by one edge 27, of container 20 which is fitted with a pair of support openings 28 formed at opposite ends of edge 27 to allow support 40 to pass through each of the openings 28 so that the assembly may be suspended from a support structure. It can be seen that the two openings 28 define between them a line, in this case edge 27, that clearly is parallel to both edge 27 and the width dimension of panel member 30. The inner side of edge 27 defines a loop around rod 40 to suspend container 20, with panel member 30 within it, from support rod 40, when the rod is suspended from a wall in the horizontal position. To aid in maintaining the desired shape of container 20, the opposite walls 21 of container 20 adjacent to edge 27 may be stitched or otherwise fastened together, as at 29, parallel to and at a reasonable distance from edge 27 so as to form a "pocket" for receiving support 40. As shown in FIG. 2, rod 40 may be hung from (e.g. attached to) wall 100 by any suitable means such as conventional curtain brackets 101.

Figure 4:
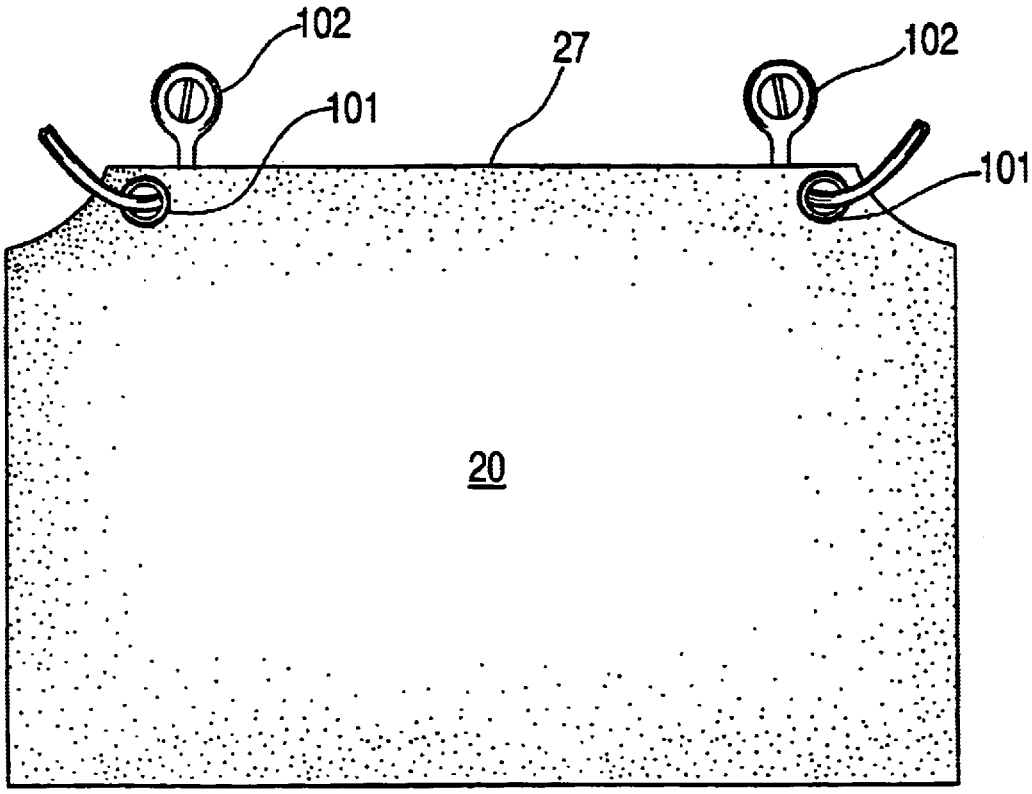
FIG. 4 is a simplified pictorial representation of another embodiment of the invention.

In applications where it may be desired to avoid use of support rod 40, container 20 may be provided with suitably strong direct openings such as grommets 101 in spaced apart locations along edge 27, as shown in FIG. 4. The openings 101, of suitable size and construction, will permit container 20 to be hung directly on hooks 102 or any other form of suitable projections that are directly attached to a rigid wall or other rigid support structure that is capable of supporting and maintaining them a fixed distance apart from each other. The fixed distance maintains container 20 properly "spread" on the support in substantially flat panel-like array, without undue "sag" between the spaced apart support points at grommets 101.

Figure 3:
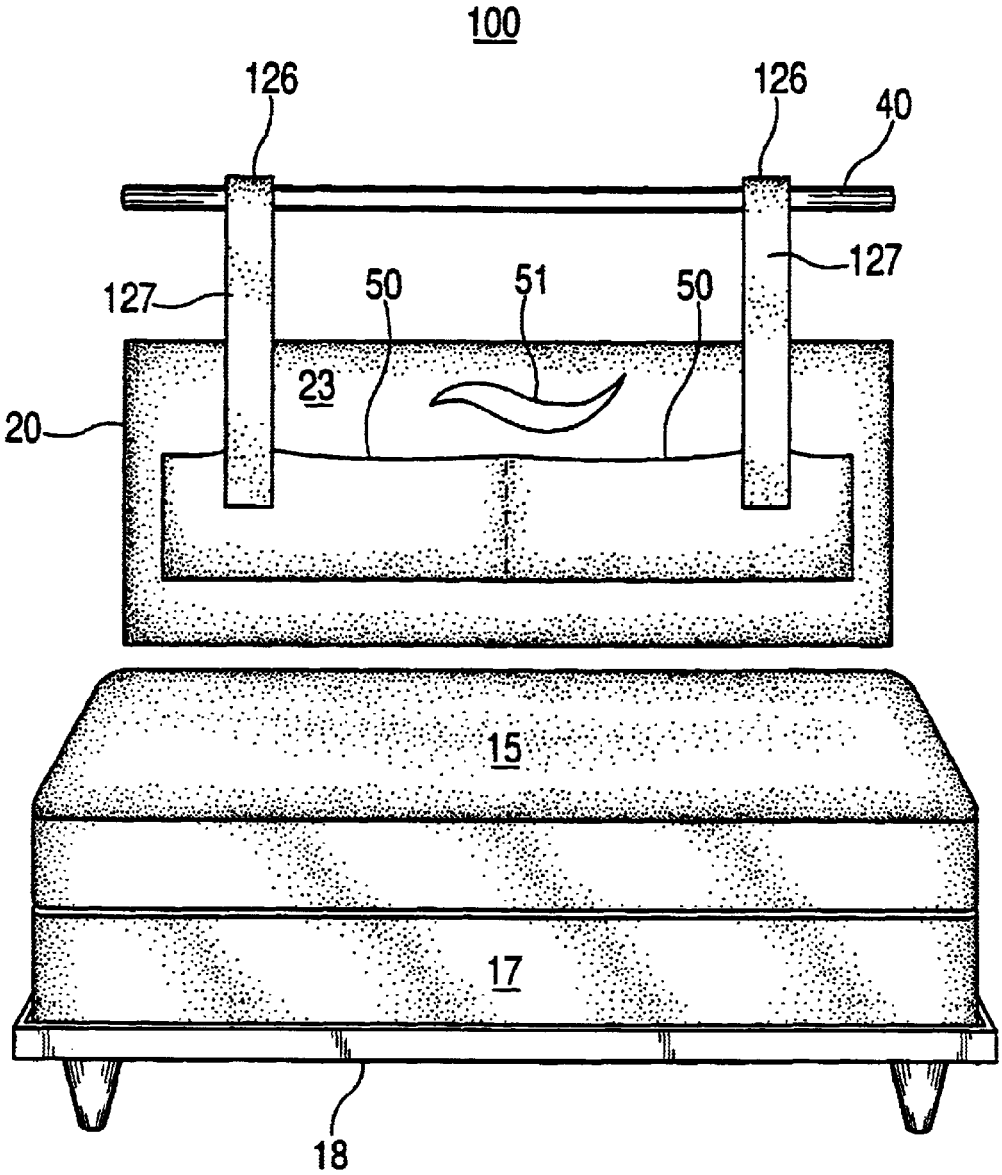
FIG. 3 is a simplified pictorial representation of another embodiment of the invention.

In the embodiment of the invention shown in FIG. 3, support portion 126 of fabric container 20 comprises two strap members 127 that are secured to container 20 in substantially parallel, spaced-apart relation to each other, in position to be receive support 40 within the loop shape of each strap 127, in the same manner as portion 26 shown in FIG. 2. FIG. 3 illustrates, in the interest of clarity, how an ornamental pattern or other decorative visual image 51 may be made to appear on the exposed surface of container 20 to enhance its visual appearance. The headboard of FIG. 3 is further modified by the formation of receptacle pockets 50 on one of the substantially flat surfaces 23 of container 20. Those with or without skill in this art will recognize that receptacle pockets 50 are readily accessible to any occupant of an adjacent bed who may use the pockets to retain ordinary bedside accessories such as tissues, magazines, books, telephones, etc.

If desired, specifically-shaped receptacle pockets may be provided to retain correspondingly shaped articles such as hanging lamp fixtures, radios, and the like. It should be clear in view of the disclosure of the invention herein presented, that pocket receptacles of any kind may be incorporated into the forms of the invention disclosed in FIGS. 1 and 2, as well as into any form of the invention that falls within the spirit and scope of this disclosure and the claims that follow.

Although a preferred embodiment of the invention has been illustrated and described, those having skill in this art will recognize that various other forms and embodiments now may be visualized readily without departing significantly from the spirit and scope of the invention disclosed herein and set forth in the accompanying claims.

What is claimed is:

1. A bed headboard assembly (10) adapted to be supported independently of connection to any portion of an adjacent bed by an elongate support member (40) hung on an available vertical structure (100), said headboard assembly comprising:

a generally soft, panel-like member (30) having length and width dimensions that are substantially greater than its thickness dimension;

a fabric container (20) enclosing said panel-like member and having an access opening (22) therein for insertion and removal of said panel-like member;

said access opening having separable closure means (24) associated therewith for enclosing said panel-like member within said fabric container; and a pair of loop-shaped strap members (127) extending from one edge of said fabric container in substantially parallel, spaced-apart relation to each other, for receiving an elongate, substantially rigid support member within the loop shape of each strap member.

2. The bed headboard assembly of claim 1, wherein:

said panel-like member is suspended from said support member when said support member is hung in a substantially vertical position.

3. The bed headboard assembly of claim 2, wherein:

said elongate support member is attachable to an available vertical structure (100) for suspending said headboard assembly therefrom.

4. The bed headboard assembly of claim 2, wherein:

said support member (40) is coupled to said panel-like member (30) by capturing a portion of said support member within said fabric container (20) and said fabric container further comprises a first support opening (28) therein giving access to said support member.

5. The bed headboard assembly of claim 2, wherein:

said support member is coupled to said panel-like member by capturing a portion of said support member within said fabric container and said fabric container further comprises a plurality of support openings (28) therein giving access to said support member, and allowing said support member to extend from the interior to the exterior of said fabric container.

6. The bed headboard assembly of claim 1, wherein:

said fabric container includes a decorative pattern visible on the outer surface thereof.

7. The bed headboard assembly of claim 1, wherein:

said separable closure means is formed of hook and loop material.

8. The bed headboard assembly of claim 1, wherein:

said separable closure means is a zipper.

9. The bed headboard assembly of claim (1), wherein:

said fabric container (20) further comprises a pocket recess (50) in the exterior surface thereof for storing articles in a position readily accessible from an adjacent bed.

* * * * *